United States Patent [19]

Fasola

[11] Patent Number: 4,825,844

[45] Date of Patent: May 2, 1989

[54] IGNITION SYSTEM FOR AN INTERNAL COMBUSTION ENGINE

[75] Inventor: Giancarlo Fasola, Milan, Italy

[73] Assignee: Magneti Marelli S.p.A., Milan, Italy

[21] Appl. No.: 929,882

[22] Filed: Nov. 13, 1986

[30] Foreign Application Priority Data

Nov. 13, 1985 [IT] Italy ..... 67960 A/85

[51] Int. Cl.[4] ..... F02P 7/03

[52] U.S. Cl. ..... 123/643; 123/605; 123/634; 123/635

[58] Field of Search ..... 123/643, 605, 634, 635

[56] References Cited

U.S. PATENT DOCUMENTS

| | | | |
|---|---|---|---|
| 964,007 | 7/1910 | England | 123/635 |
| 1,011,884 | 12/1911 | Cavanagh | 123/634 |
| 3,621,826 | 11/1971 | Chrestensen | 123/643 |
| 3,934,570 | 1/1976 | Asik et al. | 123/605 |
| 4,502,454 | 3/1985 | Hamai et al. | 123/643 |
| 4,617,907 | 10/1986 | Johansson et al. | 123/635 |
| 4,733,646 | 3/1988 | Iwasaki | 123/643 |

FOREIGN PATENT DOCUMENTS

| | | | |
|---|---|---|---|
| 2324306 | 12/1974 | Fed. Rep. of Germany | 123/634 |
| 59-226274 | 12/1984 | Japan | 123/643 |
| 59-226279 | 12/1984 | Japan | 123/635 |

*Primary Examiner*—Andrew M. Dolinar

*Attorney, Agent, or Firm*—Sughrue, Mion, Zinn, Macpeak & Seas

[57] ABSTRACT

The system comprises a low-voltage electrical supply, an inductive voltage-increaser, a plurality of plugs, and distribution means for allowing the selective supply of high voltage to the plugs through the voltage-increaser.

The latter comprises a low-voltage winding through which current flows each time a spark is prouduced in at least one plug, and a plurality of coils each of which is associated with a respective plug. Each coil includes first and second windings magnetically coupled together, the second winding being connected electrically to the plug. The distribution means are also adapted to connect the first winding of one or more of the coils selectively to the low voltage winding and to allow current to flow through the said windings to create the spark in the plugs connected to the said coils.

8 Claims, 2 Drawing Sheets

IGNITION SYSTEM FOR AN INTERNAL COMBUSTION ENGINE

DESCRIPTION

The present invention relates to ignition systems for internal combustion engines and particularly to static distribution ignition systems.

The invention provides an ignition system of the type comprising a low-voltage electrical supply, inductive voltage increase means, a plurality of ignition plugs, and distribution means for allowing the selective supply of high voltage to the plugs through the voltage-increase means.

In ignition systems with rotary distributors the inductive-voltage increase means are usually constituted by a single coil comprising a core of ferromagnetic material and two windings, a primary winding and a secondary winding respectively, superposed around this core.

In other ignition systems, and particularly in static-distribution ones, it is necessary to provide an ignition coil for each plug or cylinder of the engine. Given the dimensions of each individual coil, this solution has the problem of considerable bulk.

In order to reduce the bulk, the invention proposes an ignition system as specified above which is characterised in that the voltage-increase means comprise a common low voltage winding through which current flows each time a spark is produced in at least one plug and a plurality of coils each of which is associated with a respective plug and includes first and second windings magnetically coupled together, the second winding being connected electrically to the plug, the distribution means being adapted to connect the first winding of one or more of the coils selectively to the common winding and to allow current to flow through these windings to create the spark in the plugs (SP) connected to the said one or more coils.

According to a further characteristic, each of the coils is connected directly to the corresponding plug without the interposition of any connecting cable.

In the ignition system of the invention, the raising of the voltage for initiating sparking in a particular plug is achieved by means of a transformer whose primary winding is formed by the common winding and by the first winding of the coil associated with the plug. The secondary winding of this transformer is the second winding of this coil.

This solution enables the bulk and the heat dissipation in the plugs to be reduced and also enables the coils to be mounted directly on the plugs.

Figure 1:
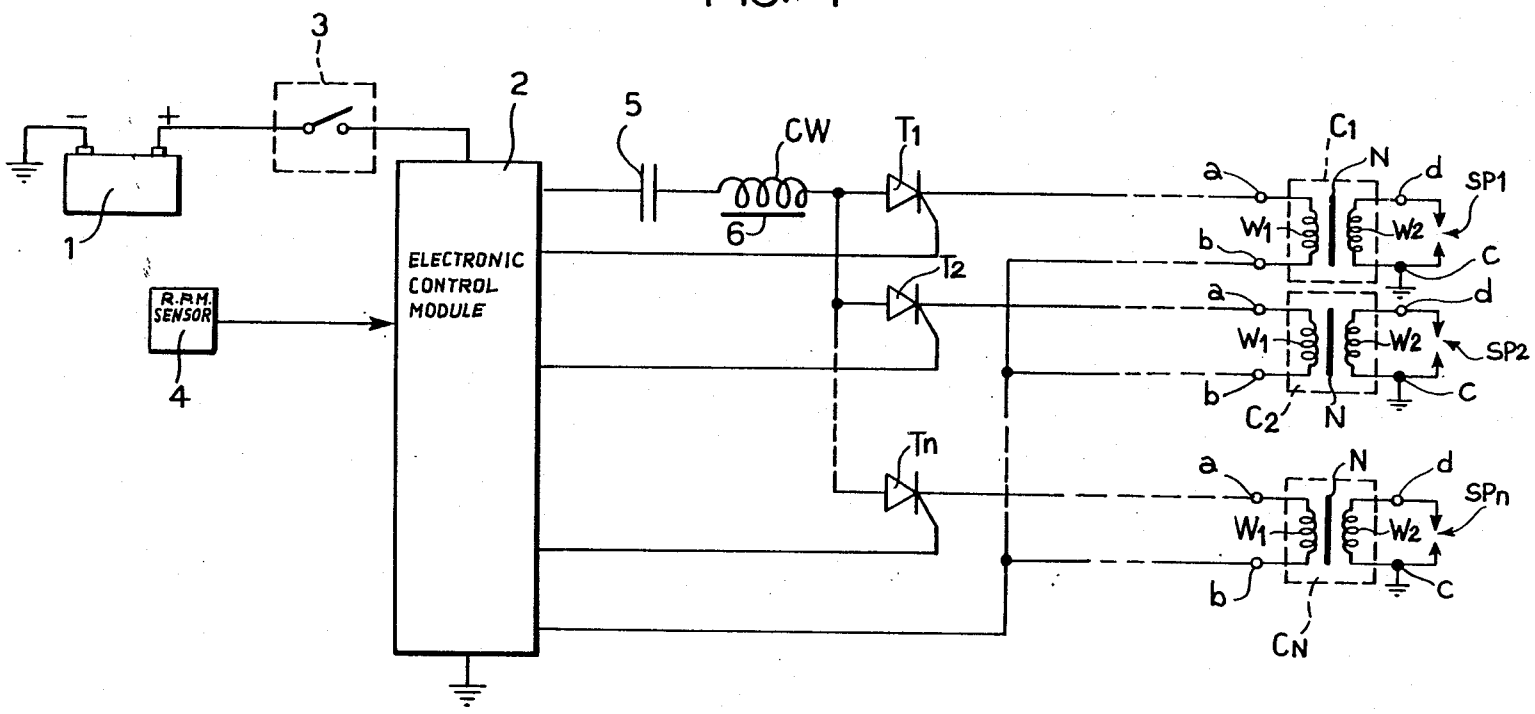
Figure 3:
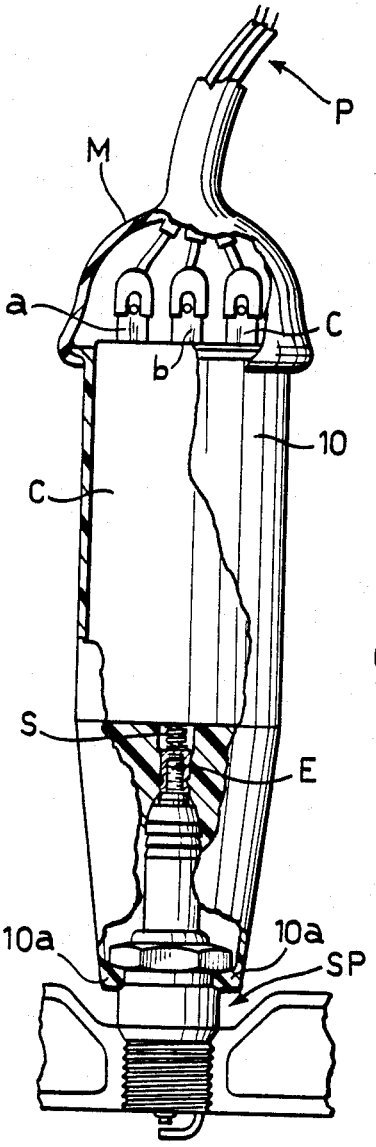
Figure 2:
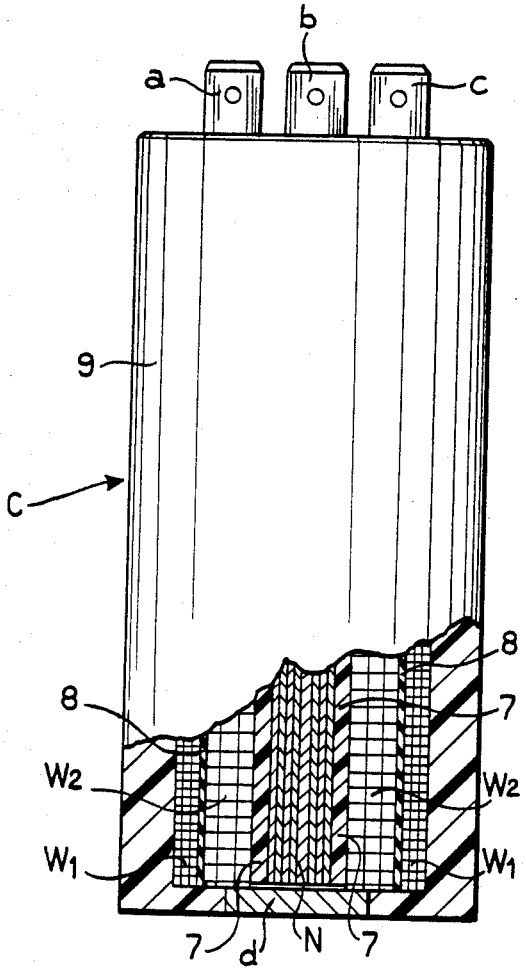

Further characteristics and advantages of the system according to the invention will be apparent from the detailed description which follows with reference to the appended drawings, provided purely by way of non-limiting example, in which:

FIG. 1 is an electrical diagram, partially in block form, illustrating one embodiment of an ignition system according to the invention, FIG. 2 is a partially-sectioned view of a coil used in the ignition system of the invention, and FIG. 3 shows the mounting of a coil directly on a plug by way of example.

With reference to FIG. 1, an ignition system according to the invention includes a battery 1 acting as an energy source and connectible to an electronic control module 2 through a switch 3 for example of the key operable type.

The electronic control module 2 is connected to a sensor 4, for example of the phonic wheel type comprising a magnetic detector (pick-up) associated with a member rotatable by the rotation of the cam shaft and provided with detectable references.

The control module 2 may also be connected to further sensors such as, for example, a sensor for sensing the temperature of the engine and a sensor for sensing the vacuum in the induction manifold of the engine.

The electronic control module 2 is connected through a capacitor 5 to a winding CW wound on a core 6 formed from sheets of ferromagnetic material. To one end of the winding CW are connected the anodes of n thyristors T1–Tn (n being the number of cylinders of the engine). The gate electrodes of these thyristors are connected to the electronic control module 2.

References C1–Cn indicate n coils each comprising a primary winding and a secondary winding indicated W1 and W2. These windings, as will be more fully described below, are wound on a core N of ferromagnetic sheets.

The windings W2 are connected to the plugs SP1–SPn.

The windings W1 are connected at one end to the cathodes of the associated thyristors T1–Tn and at their other ends are connected together and to the electronic control module 2.

In operation, when the switch 3 is closed and the engine started, the electronic control module 2 causes the triggering of the thyristors T1 to Tn in a predetermined sequence in dependence on the signals supplied to it by the sensor 4 and any other sensors mentioned above. When the thyristor T1 for example is triggered the winding W1 of the coil C1 is connected in series with the winding CW: these together constitute the primary winding of a transformer, the secondary winding of which is represented by the winding W2 of the coil C1. The module 2 causes a pulse of current to flow through CW, T1 and W1 and the consequent sparking of SP1.

Similarly, when the thyristor Tn is triggered, the common winding CW is put electrically in series with the winding W1 of the coil CN to cause the plug SPn to spark.

As stated, each time a thyristor is triggered, the common winding CW is connected in series with the winding W1 of the corresponding coil. The common winding CW generally has a mutual inductance M of zero with the winding W2, while the winding W1 has a coefficient of mutual inductance M with the winding W2 of at most 1.

It is known that there is an optimum value of the mutual inductance between two windings: this optimum value is not $M=1$, but is close to 0.8.

If then the windings W1 and W2 of the coils C are made so that they have a mutual inductance close to or equal to 1 it is possible to make the mutual inductance between the winding W2 of each coil and the series formed by CW and W1 to be equal to or close to the optimum.

FIG. 2 illustrates one embodiment of a typical coil C. In this embodiment the coil C includes a rod shaped core N formed from sheets of ferromagnetic material, surrounded by a tubular sheath 7 of electrically-insulating material, for example nylon. Around the sheath 7 is the winding W2 and around this is a layer 8 of electrically-insulating material such as paper on which the winding W1 is wound. The unit thus formed is encapsulated in a synthetic resin casing 9 having, for example, an outer diameter of about 3 cm and a length of about 6 cm.

A metal disc d is incorporated in the resin layer and covers one end face of the coil and is connected to the winding W2. As will be seen below, the disc 10 is intended to enable the winding W2 to be connected to the central electrode of a plug.

In FIG. 2 three contact members a, b, c are shown in the form of flat pins partly embedded in the layer of resin which covers the other end face of the coil and connected in order to the ends of the winding W1 and to the other end of the winding W2.

FIG. 3 shows an example of the mounting of coil C directly on a respective plug SP, without the interposition of any connecting cable. In this mounting, a tubular sheath 10 is used the lower part of which is fitted onto the plug SP and is snap engaged with a projection of the plug body by means of sprung teeth 10*a*. The coil C is housed in the upper part within the sheath 10 and a helical spring S of electrically-conductive material is interposed between the end disc d and the central electrode E.

A connector M supported at one end by a low-power connecting cable P is coupled to the terminals a,b,c.

The ignition system of the invention enables the bulk of the coils to be reduced and, as has been described, enables these to be mounted directly on the plugs.

I claim:

1. An ignition system for an internal combustion engine, particularly a static-distribution ignition system, comprising:

a low-voltage electrical supply, a plurality of ignition plugs, and distribution means for allowing the selective supply of high voltage to each of the plugs through inductive voltage-increase means including for each plug a respective transformer means having a primary and secondary winding;

the said voltage-increase means comprising a common winding through which current flows each time a spark is produced in at least one plug, and a plurality of coils each of which is associated with a respective plug and includes first and second windings magnetically coupled together; the first winding of each coil being adapted to be selectively connected electrically in series with said common winding through the distribution means so that said first winding and said common winding effectively form the primary winding of the transformer means associated with the corresponding plug, the second winding being coupled directly across a spark gap of the plug and representing the secondary winding of the said transformer; and means for applying a voltage across said primary winding.

2. A system according to claim 1, wherein each coil is connected directly to the corresponding plug without the interposition of any connecting cable.

3. A system according to claim 1 wherein the distribution means comprise controlled switch devices of static type.

4. A system according to claim 2, wherein each coil comprises a rod-shaped core formed from sheet steel an surrounded by a layer of electrically-insulating material around which is disposed the second winding, a second layer of electrically-insulating material disposed around the second winding and on which the first winding is wound, and a layer of insulating material surrounding the outside of the first winding.

5. A system according to claim 3, wherein each coil has a conductive plate at one end which is electrically connected to the second winding and is intended for connection to the central electrode of a plug.

6. A system according to claim 4, wherein each coil carries at its other end first and second electrical connecting members preferably in the form of flat pins, connected to the two ends of the first winding.

7. A system according to claim 6, wherein each coil carries a third electrical connecting member at its other end, preferably in the form of a flat pin, and connected to the second winding.

8. An ignition system for an internal combustion engine, particularly a static-distribution ignition system, comprising:

a low-voltage electrical supply, a plurality of ignition plugs, and distribution means for allowing the selective supply of high voltage to each of the plugs through inductive voltage-increase means including for each plug a respective transformer means having a primary and secondary winding;

the said voltage-increase means comprising a common winding through which current flows each time a spark is produced in at least one plug, and a plurality of coils each of which is associated with a respective plug and includes first and second windings magnetically coupled together; the first winding of each coil being adapted to be selectively connected electrically in series with said common winding through the distribution means so that said first winding and said common winding effectively form the primary winding of the transformer means associated with the corresponding plug, the second winding being connected directly to the corresponding plug without the interposition of any connecting cable.

* * * * *